US006651497B2

(12) United States Patent
Imatoh

(10) Patent No.: US 6,651,497 B2
(45) Date of Patent: Nov. 25, 2003

(54) PITCHING TRAINING TOOL WITH INDICATOR

(76) Inventor: Yasuyuki Imatoh, 20-5, Kitakarasuyama 4-Chome, Setagaya-Ku, Tokyo (JP)

( * ) Notice: Subject to any disclaimer, the term of this patent is extended or adjusted under 35 U.S.C. 154(b) by 264 days.

(21) Appl. No.: 09/779,511

(22) Filed: Feb. 9, 2001

(65) Prior Publication Data

US 2002/0020217 A1 Feb. 21, 2002

(30) Foreign Application Priority Data

Feb. 10, 2000 (JP) ..... P.2000-034034

(51) Int. Cl.[7] ..... G01L 5/00

(52) U.S. Cl. ..... 73/379.01; 73/379.02; 73/488; 473/131; 473/141; 473/143; 473/144; 482/92

(58) Field of Search ..... 73/379.01, 379.02, 73/488; 473/131, 143–154, 141; 482/92

(56) References Cited

U.S. PATENT DOCUMENTS 4,834,376 A * 5/1989 Steinberg ..... 473/457
5,616,832 A * 4/1997 Nauck ..... 73/65.03
5,779,555 A * 7/1998 Nomura et al. ..... 473/223
5,906,550 A * 5/1999 Kingston ..... 473/320
5,988,861 A * 11/1999 Baum ..... 702/142
6,143,429 A * 11/2000 Abkowitz et al. ..... 428/651
6,173,610 B1 * 1/2001 Pace ..... 73/493
6,186,961 B1 * 2/2001 Hanoun ..... 600/587
6,322,463 B1 * 11/2001 Forsythe et al. ..... 473/566

* cited by examiner

*Primary Examiner*—Edward Lefkowitz
*Assistant Examiner*—Alandra Ellington
(74) *Attorney, Agent, or Firm*—Oblon, Spivak, McClelland, Maier & Neustadt, P.C.

(57) ABSTRACT

The present invention provides a pitching training tool, comprising a rod-shaped body portion, which has a hollow, cylindrical shaft portion that is lighter than a regulation ball, and a gripping portion, which is integrally formed to one end of this shaft portion; an acceleration sensor or other such detector, which is incorporated in the gripping portion side of this rod-shaped body portion, and which detects a state of motion when the rod-shaped body portion is swung around; an arithmetic processing portion for performing computations based on motion state data from this detector; and a display for displaying the results of computations by the arithmetic processing portion, and is constituted so as to compute in the computing portion at least the rotational speed of the rod-shaped body portion based on the detection results by this detector and to display same.

12 Claims, 9 Drawing Sheets

PITCHING TRAINING TOOL WITH INDICATOR

BACKGROUND OF THE INVENTION

1. Field of the Invention

The present invention relates to a pitching training tool or pitching practice apparatus for enabling mainly pitchers, infielders and outfielders to healthfully and comfortably acquire ideal throwing form when playing baseball.

2. Description of the Related Art

In the past, as a method for a baseball pitcher to cultivate this pitching form, there was a method, whereby a large quantity of balls, for example, several hundred balls, or even several thousand balls, were thrown.

However, with this method, because the weight of a regulation professional hardball used for throwing is, for example, approximately 140–142 grams (in the case of Japan), great stress is placed on the throwing arm, shoulder, elbow, and the joints thereof. For this reason, due to the above-mentioned rigorous throwing, there are cases where the shoulder degenerates, adversely affecting a pitching career.

Accordingly, there has also been known for some time now a method, in which, instead of using a hardball, shadow pitching is practiced by holding one end of an ordinary long and narrow towel for washing one's face. According to this towel shadow pitching, since the towel is extremely light weight, the wear and tear on the throwing arm, shoulder, elbow, and joints thereof is also light, and there is practically no trouble that would shorten a pitching career.

However, with conventional towel shadow pitching such as mentioned above, because the towel is soft and has no rigidity, the towel hangs downwardly from the hand holding the towel and gets wrapped around the hand. Thus, the problem is that because the towel is held and swung around in accordance with an arbitrary pitching form, when the throwing arm is raised up to the top position of the pitching form, it is difficult to practice shadow pitching while being conscious of or checking whether or not the top position of the throwing arm and hand, for example, the elbow of the throwing arm, is in the prescribed position above the shoulder, or whether or not the wrist of the throwing arm is twisted toward the outside and the state thereof, or the path of the throwing hand and arm.

Further, the sound of the towel cutting through the air when the throwing arm is swung downward is not clearly communicated. For example, it is extremely difficult to readily distinguish by ear a change in the air-cutting sound of the towel in accordance with the swing speed at, for example, the ball release point or other such necessary checkpoint, thus providing a problem in that it is difficult to be conscious of the arm swing speed feel.

Therefore, the problem with pitching practice that uses this towel is that it is not very effective for either cultivating one's own pitching form, or for acquiring a new pitching form while checking this form by oneself.

SUMMARY OF THE INVENTION

With the foregoing in view, it is an object of the present invention to provide a pitching training tool, which is constituted such that it is possible to easily and enjoyably master an ideal pitching form while readily checking one's own pitching motion.

To achieve the above-mentioned object, the present invention provides a pitching training tool, having a rod-shaped body portion, which has a hollow, cylindrical shaft portion that is lighter than a regulation ball, and a gripping portion, which is integrally formed to one end of the shaft portion; a detector, which is incorporated in the above-mentioned gripping portion side of the above-mentioned rod-shaped body portion, and which detects a state of motion when the rod-shaped body portion is being swung around; an arithmetic processing portion, which is disposed on the gripping portion side of the above-mentioned rod-shaped body portion, and which carries out computations based on motion state data from the above-mentioned detector; and a display, which is disposed on the gripping portion side of the above-mentioned rod-shaped body portion, and which displays the results of computations by the above-mentioned arithmetic processing portion.

Furthermore, in the preferred embodiments of the present invention, the above-mentioned detector is an acceleration sensor, and the above-mentioned arithmetic processing portion is a CPU (central processing unit) comprising means for detecting rotational frequency when the rod-shaped body portion is being swung around, and rotational speed detecting means for detecting rotational speed.

Further, the above-mentioned display is constituted so as to display at least one of a rotational speed, or a pitching speed computed on the basis of this rotational speed.

Further, there is incorporated, in the gripping portion side of the above-mentioned rod-shaped body portion, a sound device, which is constituted so as to be operationally connected to the above-mentioned computing means, and to output tonal sounds that differ in accordance with the speed level of the rotational speed.

Further, it is possible for the rotational frequency detector, the rotational speed detector, and the sound device to be regarded as a unit, and to be housed in a single casing.

Further, it is also possible for the display device to be housed together with the unit inside the casing.

Further, the shaft portion of the rod-shaped body portion can be formed having flexibility by using glass fiber, titanium, carbon and the like.

Further, on the gripping portion, It is possible to form a non-slip portion for preventing the gripping hand from slipping.

Further, on the outer end portion of the non-slip portion, it is also possible to form a grip end with a larger diameter than the non-slip portion thereof.

Furthermore, as for the gripping portion, it is also possible to provide either a spherical body of a larger diameter than the rod-shaped body portion, or a triangular-shaped body of a size greater than the length perpendicular to the axis of the rod-shaped body portion.

According to the disclosures of the above-mentioned present invention and the preferred embodiments thereof, when performing shadow pitching, whereby the gripping portion of the pitching training tool thereof is gripped by the throwing hand and swung around in accordance with an arbitrary pitching form, the pitching training tool feels just like a fourth joint contiguous with the three joints of the shoulder joint, elbow joint and wrist joint of the throwing arm.

Thus, shadow pitching can be performed while being conscious of the top position of the throwing arm and hand, the twisting of the wrist and the state thereof, and the path of the throwing arm and hand.

Further, because the flexible rod-shaped body generates a sharp air-cutting sound when the throwing arm is swung around, one can be conscious of the swing down speed of the arm by the level of the tone of the air-cutting sound thereof. Thus, it is possible to perform shadow pitching while being conscious of the speed at the pitch release point and other such strategic places. Furthermore, since the number of times the pitching training tool is swung is displayed on the display, it is also possible to confirm the number of times thereof.

Thus, since it is possible to readily check the quality of one's own pitching motion or form, by repeating this shadow pitching, it is possible to readily cultivate a pitching form for one's own pitching, or to easily acquire an arbitrary pitching form while revising one's own pitching motion or form.

Moreover, because the overall weight of this pitching training tool is lighter than either a professional or amateur regulation hardball, it is possible to greatly reduce the stress placed on the throwing arm, shoulder, elbow, and the joints thereof. Thus, shadow pitching can be performed healthfully and comfortably without subjecting the throwing arm, shoulder, elbow, and joints thereof to wear and tear and without shortening a pitching career.

Further, in addition to reducing the stress placed on the throwing arm, shoulder, elbow, and the joints thereof, because a pitching motion is a total body movement, the present invention also has the effect of preventing stiffening of the shoulder and subacromial bursitis and can promote health.

Furthermore, because the rotational frequency detector and display are provided on the gripping portion side instead of being disposed at the tip portion side of the rod-shaped body, even if the end portion of the rod-shaped body should impact the ground or something when the pitching training tool is swung down, damage to the rotational frequency detector and display thereof can be prevented.

Further, the rotational speed when the pitching training tool is swung around in accordance with shadow pitching can be checked more accurately via the display than by distinguishing by ear the differences in the tone of the air-cutting sound made by the rod-shaped body. Further, since this rotational speed detector displays on the display the rotational speed detection value thereof as the pitching speed of a ball had the ball in question been thrown at the arm swing speed thereof, the enjoyment of shadow pitching can be increased.

Furthermore, apart from the air-cutting sound of the rod-shaped body, since a plurality of tonal sounds that differ in accordance with the rotational speed of the pitching training tool are outputted from the sound outputting device, by listening to the tones thereof while shadow pitching, it is possible to learn the swing speed of the rod-shaped body or the pitching speed more accurately than by the air-cutting sound.

Thus, since it is not necessary to stop shadow pitching part way through each time to look at the display showing the rotational speed of the pitching training tool, the effects of practice can be enhanced.

Further, since the length of the rod-shaped body of the pitching training tool can be appropriately adjusted in accordance with the size of a user's body, especially his height, and the method of practice, a single pitching training tool can be used by a wide-range of individuals, from adults to children.

Further, slippage when a user grips the gripping portion of the pitching training tool can be prevented by a non-slip portion and a large-diameter end portion. Thus, since it is possible to prevent the pitching training tool from slipping out of the gripping hand when this pitching training tool is swung down, the safety of the surrounding area can be enhanced.

Furthermore, since the gripping portion of the pitching training tool comprises either a spherical body or an arbitrarily shaped body approximating a regulation hardball, it is possible to securely grip the gripping portion thereof in practically the same manner as a regulation hardball, while at the same time making it possible to prevent slippage.

DESCRIPTION OF THE PREFERRED EMBODIMENTS

The embodiments of the present invention will be explained hereinbelow based on FIG. 1–FIG. 17. Furthermore, in the figures thereof, the same reference symbols are assigned to the same or similar parts.

Figure 1:
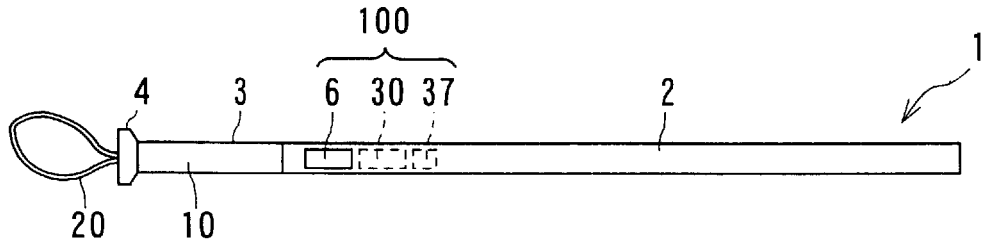
FIG. 1 is a simplified front view of a pitching training tool related to a first embodiment of the present invention.

FIG. 1 is a simplified front view of a pitching training tool 1 related to a first embodiment of the present invention. This pitching training tool 1 integrates or integrally forms a hollow, cylindrical shaft 2, which is a rod-shaped body, and which has some bendability (flexibility); a grip 3, which is a gripping portion formed at one end portion thereof; and a grip end 4, which is formed at one end portion of the grip 3 thereof, and which has a slightly larger diameter than the outer diameter thereof, and the length from the outer tip of the grip end 4 thereof to the tip of the shaft 2 is formed, for example, either approximately 610 mm (in the case of Japan) or approximately 450 mm long, which is practically equivalent to the length of the pitching rubber.

It is desirable for the shaft 2 to be formed from a material such as, for example, glass fiber, titanium, or carbon, and the shaft 2 is formed in a hollow, cylindrical shape of a diameter of, for example, around 10 mm–30 mm, and of a length of, for example, around either 300 mm–700 mm, and both end portions are integrally sealed. However, the shaft 2 can also be a triangular, square, pentagonal, hexagonal or other polygonal tube.

Figure 2:
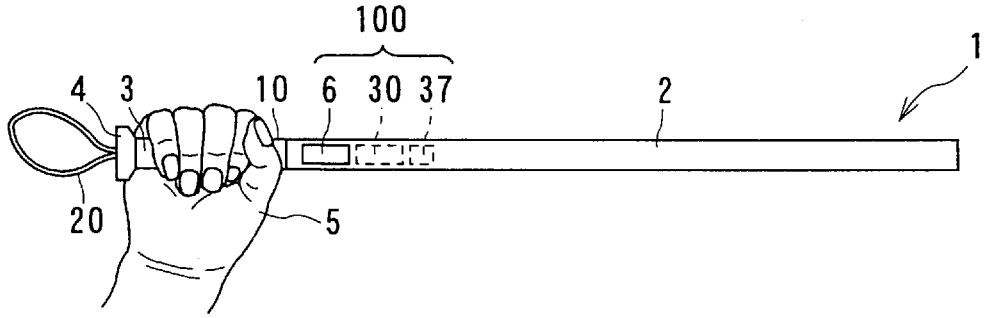
FIG. 2 is a diagram showing the gripping state of a gripping portion of the pitching training tool shown in FIG. 1.

As shown in FIG. 2, the grip 3 is sufficiently long to enable gripping by a user's hand 5, and a non-slip portion 10 can be formed by winding rubber or the like and fastening same in a fixed condition to the periphery of the grip 3. As a non-slip portion 10 thereof, instead of rubber, either a plurality of grooves can be directly formed at a predetermined pitch in the peripheral surface of the grip 3 or indented portions for gripping can be formed over the entire peripheral surface of the grip 3. It is desirable to attach a loop-shaped strap 20 for holding to the grip end 4.

Then, the bottom portion of a display 6, comprising an LED (for example, a trichromatic light-emitting diode) segment or a small liquid crystal display (LCD), is embedded into the external surface of the shaft 2 of the grip 3 side thereof such that the external surface thereof becomes practically flush with the peripheral surface of the shaft 2, and a cylindrical casing 30 is provided in a fixed condition inside the shaft 2 in the vicinity of this display 6.

Figure 7:
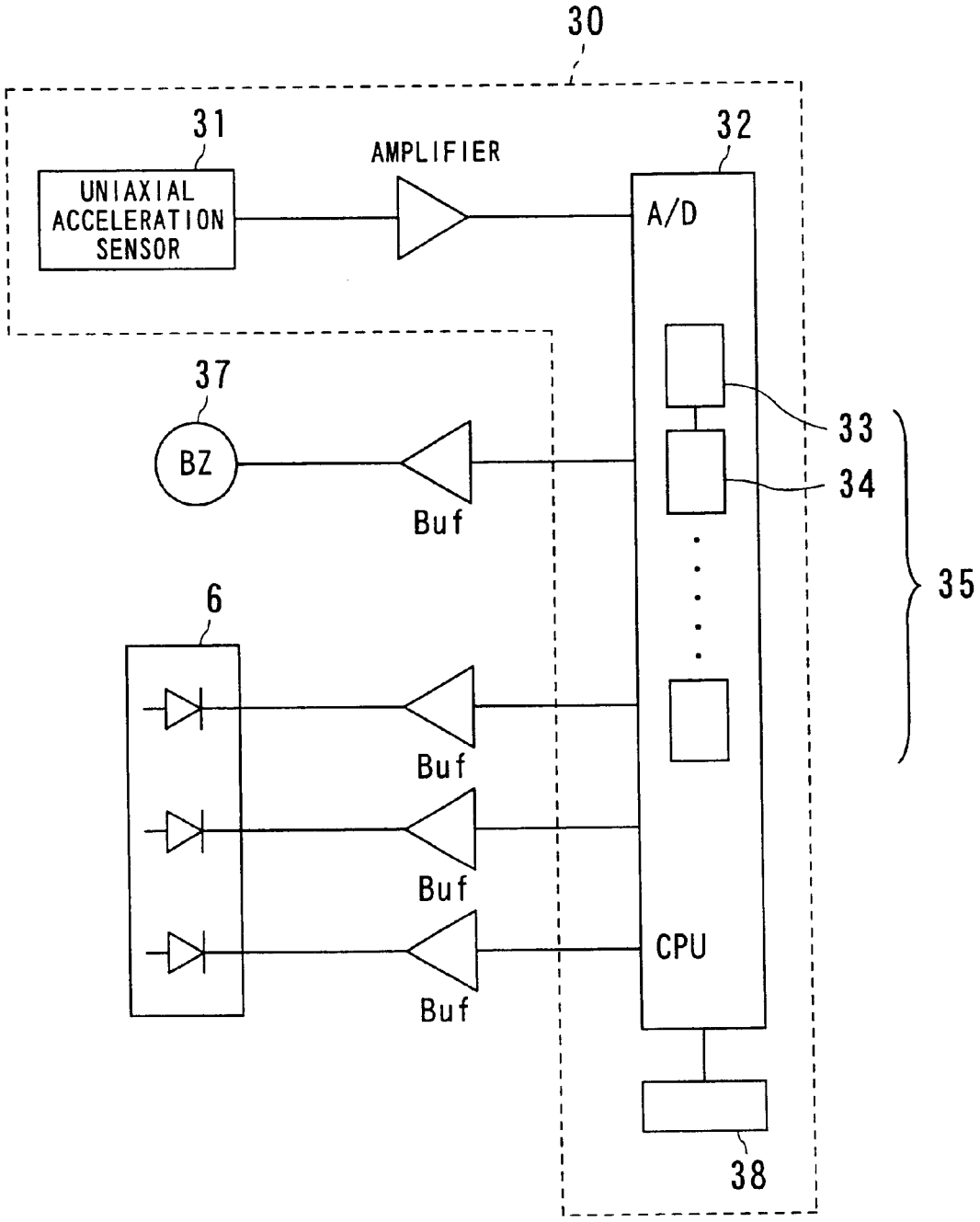
FIG. 7 is a circuit diagram showing the connections of each of the detector, CPU, display and so forth provided in a pitching training tool of the present invention.

On the inside of the casing 30, which is depicted in the circuit diagram of FIG. 7, there is disposed a uniaxial acceleration sensor 31 for detecting a state of axial motion when a user grips and moves the rod-shaped pitching training tool 1, and the state of motion of a pitching training tool 1 is inputted to a microcomputer or other such CPU 32 from the acceleration sensor 31 thereof. (In other words, changes in applied acceleration are converted to voltage as acceleration.) Inside the CPU 32 thereof, there is disposed computing means 35 comprising at least one or both of a rotational frequency detector 33 and rotational speed detector 34 for performing computations based on information from the acceleration sensor 31. Furthermore, the computing means 35 is constituted such that a value computed by these detectors is outputted to a display 6, comprising, for example, a trichromatic light-emitting diode, and displayed in analog form.

Further, the present invention can be constituted such that a sound outputting device 37 is disposed in the rod-shaped pitching training tool 1 in the vicinity of the casing 30 and display 6 thereof and is electrically connected to the above-mentioned rotational frequency detector 33 and rotational speed detector 34. This sound outputting device 37 divides a detection value into a plurality of segments, and outputs the value thereof as sound in accordance with the segments thereof. Furthermore, a small-sized battery 38 for supplying power to each of the detectors and devices thereof, is disposed inside the casing 30 so as to be replaceable.

Further, it is also possible for the present invention to be constituted so as to enable a memory device (not shown in the figures) to be disposed in either the above-mentioned display 6 or CPU 32, and to store, and thereafter fetch display contents and detection contents. Furthermore, it is also possible to incorporate all of the above-mentioned CPU 32, display 6 and sound outputting device 37 inside a single casing 100.

The rotational frequency detector 33 detects the acceleration of a movement via a uniaxial acceleration sensor 31 when a user grips the grip 3 and swings same around in accordance with a desired pitching form, detects and computes the rotational frequency based on the value thereof, and displays same on the display 6. For example, the rotational frequency detector 33 is constituted so as to count the number of rotations (swings) of a pitching training tool 1 based on a count of the number of swings of a small-sized pendulum not shown in the figures, which swings back and forth in accordance with the swinging around of the pitching training tool 1, or a count of the number of back-and-forth movements of a small ball, which moves back and forth in accordance with the swinging around of the pitching training tool 1, but this constitution is not limited thereto. Furthermore, here, the swinging around of the pitching training tool 1 refers to the swinging of a throwing arm in various pitching methods.

Meanwhile, the rotational speed detector 34 detects the swinging speed of the pitching training tool 1 and is constituted so as to detect the swinging speed thereof based on the swinging speed of a small-sized pendulum or the back-and-forth speed of a small ball the same as in the rotational frequency detector 33, but the constitution thereof is not limited thereto.

Further, the rotational speed detector 34 thereof is constituted so as to convert a rotational speed detection value thereof to a pitching speed at a time when a ball, such as a regulation hardball or softball, has been thrown at the rotational speed thereof and to display same on the display 6. Further, the display 6 can be constituted so as to enable the display of a degree of attainment, such as beginner, intermediate, or advanced, together with the display of the pitching speed by providing a display mode selection switch for selecting a display mode.

Meanwhile, the sound outputting device 37 segments into a plurality of level a rotational speed detection value of the pitching training tool 1, which was detected by the rotational speed detector 34, and outputs sounds by changing the tone in accordance with the segments thereof. For example, the sound outputting device 37 can be constituted so as to control a sound from a long beep sound to a short beep—beep sound by sequentially changing the length per unit time of the long beep sound, but the sound outputting device 37 is not limited to a method for controlling the tones thereof. Furthermore, in addition to constituting the shaft 2 in a freely retractable condition, the shaft 2 can also be constituted so as to enable the retracted length thereof to be properly maintained. Further, pitching training tool 1, 1A, 1B can be constituted for beginner, intermediate, and advanced, respectively, in accordance with the pitching speed.

The overall weight of a pitching training tool 1 constituted in this manner should, for example, be lighter than the roughly 141.1–141.8 g of a regulation hardball (in the case of Japan), and, for example, ½ to ⅓, or ¼ or less therethan is desirable. This is to reduce the stress placed on a user's throwing arm, shoulder, elbow, and the joints thereof.

Figure 3:
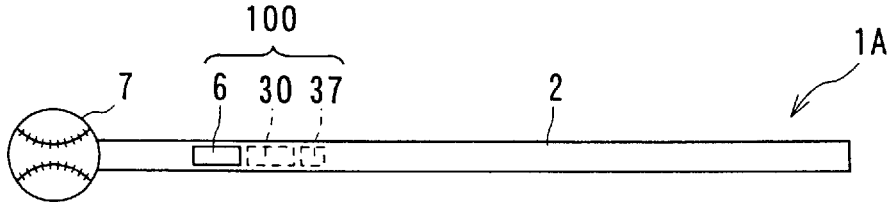
FIG. 3 is a front view of a pitching training tool related to a second embodiment of the present invention.
Figure 5:
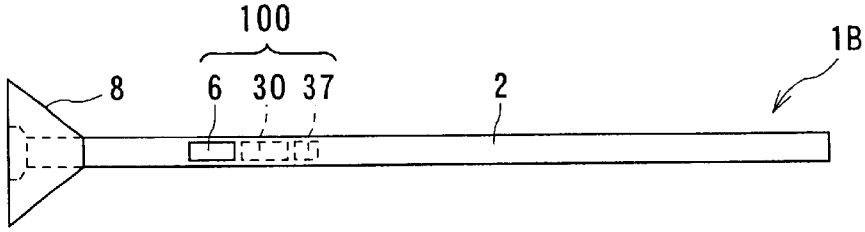
FIG. 5 is a front view of a pitching training tool related to a third embodiment of the present invention.

Furthermore, the above-mentioned grip 3 shown in FIG. 1 can be formed into a ball-shaped grip 7, which is a spherical body, as in the pitching training tool 1A shown in FIG. 3, or the grip 3 can be formed into a triangular-shaped grip 8 as in the pitching training tool 1B shown in FIG. 5, and it is better if the shape of the grip 3 is arbitrary.

The ball-shaped grip 7 is formed in practically the same shape, same size, and same quality as a regulation hardball, but is formed lighter than a regulation hardball via a hollow, spherical body.

Figure 4:
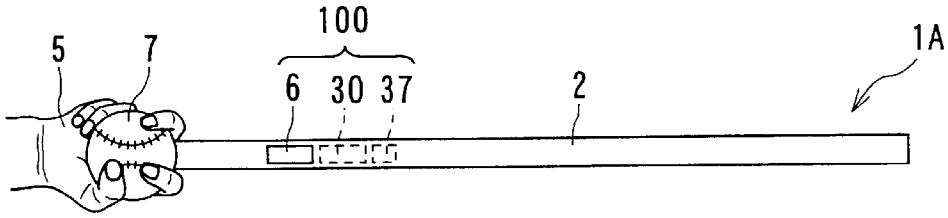
FIG. 4 is a diagram showing the gripping state of a ball-shaped gripping portion of the pitching training tool shown in FIG. 2.
Figure 6:
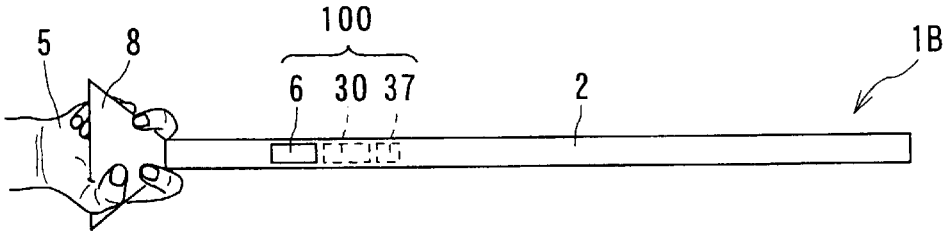
FIG. 6 is a diagram showing the gripping state of a ball-shaped gripping portion of the pitching training tool shown in FIG. 5.

As shown in FIG. 4 and FIG. 6, a ball-shaped grip 7 and a triangular-shaped grip 8, for example, are gripped by the index finger, middle finger and thumb of a user's hand 5, and same are gripped such that the base portion of the shaft 2 is positioned between the index finger and middle finger thereof. However, it is better if the gripping method thereof is arbitrary.

Now then, because pitching training tool 1, 1A, 1B constituted in this manner are utilized in shadow pitching for a user to either cultivate his own pitching form or to acquire an ideal pitching form based on the so-called Imato pitching theory developed by the inventors, this Imato pitching theory will be explained next.

(1) This theory primarily sees the movement of the body when a pitcher is pitching as two circular motions, i.e. the rotation of the hips (small circle) and the rotation of the arm (large circle), and three triangles, and states that when the "two circular motions" and "three triangles" thereof mesh with one another in a timely manner, a ball can be thrown in a pitching course practically as desired, and moreover, ideal pitching can be achieved without a drop in power. This theory will be outlined hereinbelow.

(2) "Two Circles"

Here, two circles refers to (1) a circle described by regarding the right and left hip bones as two ends, and rotating around the axis of the body (small circle or lower circle), and (2) a circle describing a center line, which extends to the right and left arms from the Danchuu of the chest (big circle or upper circle). Incidentally, the Danchuu is a spot located near the solar plexus between the lungs.

As for these two circles, a pitcher rotates his body having a "center line (axis of the body)" extending from the "Hyakue" located at the top of the head, through "Danchuu" (the middle abdomen), "Shimo-Tandien" (lower abdomen), knees and then to the bottoms of the feet. The exit angle of the arm changes according to each pitching form, i.e. overhand, sidearm and underhand, but the two circles must maintain the same angles for all styles, and rotate in parallel.

Now then, there are important factors for increasing both "power and control" in accordance with the two circular motions. In conventional technical writing, the expression "turn like a top" is used to refer to the rotation of the body, but this theory is based instead on two "time differentials." That is, the first thereof is the existence of a "time differential" whereby the "lower circle" starts rotating first, and the "upper circle" rotates as if in response thereto. The second thereof is a starting action for further accelerating the rotation of these two circles, in other words, a "time differential" accompanying the displacement of the center of gravity. It is the same for swinging a bat or swinging a golf club, and the "twisting" and "pliancy" of the body produces repulsive force in accordance with the "two time differentials" thereof, providing power to a pitch. For example, if the "two circles" rotate at the same time when pitching, for a right-handed pitcher, since the left shoulder opens up faster, and the release of the ball is also hastened in response thereto, the ball will probably shoot without having any power, and control will also be lax.

(3) Superiority of Lower Circle and Angles of Two Circular Tracks

Of the two circles, it is necessary to consciously make the "lower circle" rotate more accurately. This is because, since the side of the "lower circle" is near the "center of gravity," if the track of the "lower circle" is irregular, it will effect a pitcher's balance, which is the basis of pitching. Carrying this logic to the extreme, if a pitcher is conscious of his "center line (body axis)," rotates the "lower circle" properly, and does not exert unnecessary force, the upper circle will automatically "rotate at the same angle."

Cases in which the "lower circle" is rotated sideways by a pitcher even though it is an overhand throw are seen often. In this case, the initial triangle of the "three triangles," which will be explained hereinbelow, is made higher, that is, the rotation of the waist can be changed to an oblique rotation by raising the leg of the planting foot side higher. However, as was pointed out hereinabove, if the track of the "lower circle" is changed, the fundamental balance possessed by the pitcher thereof is apt to be lost. Further, there are numerous cases in which waist-centered movement reflects the characteristics of an individual (flexible or brawny), and excessive adjustment is likely to lead to trouble. Therefore, in this case, there are instances when it would be better to decisively switch to a pitching form that "coincides with the angle of rotation of the waist," in other words, a sidearm throwing style.

In this manner, the two circles are a motion structure, in which the side of the "lower circle" has predominance over the "upper circle," and, in addition, it is important that the "starting angles of the two circles" be made to match.

(4) Three Triangles

Figure 8C:
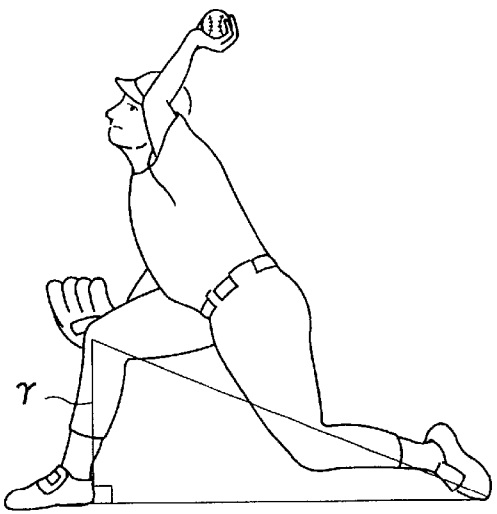
FIGS. 8A, 8B, 8C are diagrams showing each of the three triangles according to the Imato pitching theory.
Figure 8B:
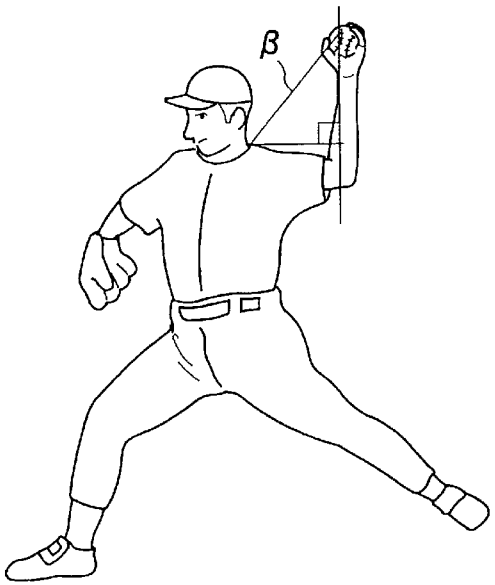
Figure 8A:
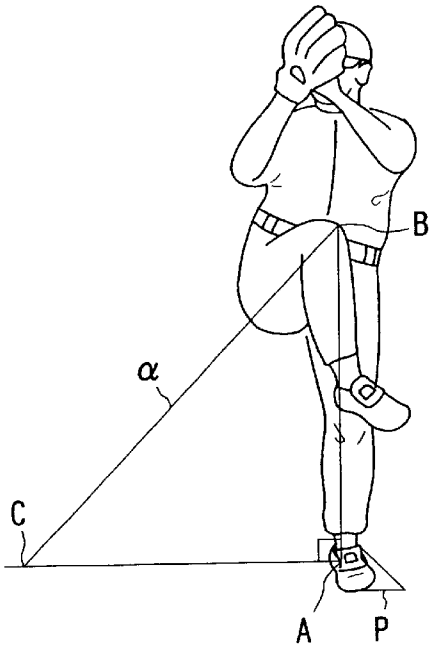

The above-mentioned "three triangles" are triangles α, β, γ shown in FIG. 8A, FIG. 8B and FIG. 8C. Furthermore, FIG. 8 depicts a case of left-handed overhand throwing, but the pitching form thereof is not limited thereto.

[1] A first triangle α shown in FIG. 8A is a triangle, which, when a pitcher raises his stepping side leg, connects the three points A, B, C, in which A is the heel of the foot on the pitching rubber P side, B is the knee of the stepping side leg, and C is the point at which the stepping side leg is planted.

[2] A second triangle β shown in FIG. 8B is a triangle formed by the "top position" of the throwing arm. Here, "top position" refers to a triangle capable of being formed at the top of the path formed by the circular motion of the arm part way through the transfer of the center of gravity of the body from the pitching rubber P side leg to the foot planting side leg.

[3] A third triangle γ shown in FIG. 8C is a triangle, which the foot planting side knee, on which the body's center of gravity is being placed, forms while the lower circle is being rotated.

Next, the respective ideal shape of the "three triangles" thereof will be explained.

(a) First Triangle α

When a pitcher gets in the set position, winds up, and is standing on one leg with the foot planting side leg raised to its highest position, the larger the area of the triangle α connecting the above-mentioned A, B, C, the greater the power produced for both ball control and a powerful delivery. Because the width of the slide corresponding to the base of triangle α remains constant with 5.5–6.5 widths of spike, the higher the leg is raised, the larger the area of the triangle α.

Further, when the foot planting side knee is brought to the top, attention needs to be paid to the following two points. First, the placement of the center of gravity firmly on the foot on the pitching rubber P side. "Release-timing adjustment" is made when moving forward, and the correctness thereof is determined by the manner in which the center of gravity is placed thereon. A lack of the release timing adjustment causes the body to open up. Second, whether or not the "chest-cross (the center point of the center line and "upper circle")" is properly facing toward third base.

If the above two points are not adhered to, balance is achieved and corrected when the foot planting side knee reaches the top position, enabling a brief pause to be taken.

(b) Second Triangle β

The "second triangle β" formed by the throwing arm is formed as close as possible to the "center line." This is because the swing of the arm does not accelerate, and ball control is lost when this triangle β is away from the body.

Next, the timing for forming the "second triangle β" will be explained.

The timing for forming the "second triangle β" is determined in relation to the shifting of the center of gravity. In other words, the throwing arm reaches the "top position" when the foot planting side leg is planted on the ground. When the shifting of the center of gravity is too rapid due to the state of the "first triangle α," this "second triangle β" ("top position") departs from the center line without being completely formed.

Therefore, as explained in (a) above, placing the center of gravity firmly on the pivoting foot of the pitching rubber P side and "release timing adjustment" when moving forward are conditions for forming the "second triangle β" with good timing.

(c) Third Triangle γ

The knee of the foot planting side leg "maintains 90 degrees" (naturally, from the knee down is perpendicular to the ground). The angle of the knee thereof governs the "level of ball control," and when this angle becomes an obtuse angle of greater than 90 degrees, like a strut, the center of gravity is repulsed backward, and the ball goes high. By contrast, when this angle is an acute angle of less than 90 degrees, the body bends forward in a state which cannot completely support the center of gravity, and the ball sinks. Further, the third triangle γ determines the "degree of pliancy" of the body, and also controls the "presence of power."

Further, when the "foot planting side knee is 90 degrees," the "upper circle" rotates by making the knee thereof the starting point of the axis of rotation. At this time, the "chest-cross" should be placed over the knee, and directly facing the pitching direction. By using the "third triangle γ" like this, the rotational speed of the above "two circles" increases, and in response thereto, the swing of the arm also becomes faster, increasing the power of the delivery.

As explained hereinabove, if the "three triangles α–γ" cannot be formed well, the "two circles" do not rotate properly either. The two exist inseparably. If these five patterns cannot be achieved, then neither power nor control will be realized, and breaking balls will not break either.

(5) Two Pitching Rhythms

Pitching rhythm can be divided into two types depending on where the center of gravity is placed. One is a "high center of gravity pitching form," whereby the center of gravity is placed on the "upper half of the body," and pitching is performed centered therearound, and another is a "low center of gravity pitching form," whereby the center of gravity is placed on the "lower half of the body," and pitching is performed centered therearound. The former constitutes a pitching rhythm of equal intervals, i.e. "1, 2, 3," and the latter constitutes a pitching rhythm in which the release timing adjustment is made therebetween, i.e. "1, 2-, 3."

(a) Pitching Rhythm of "High Center of Gravity Pitching Form"

A pitching form, which is a rhythm of equal intervals, constitutes a pitching form, in which the "center of gravity is placed in the location of the chest," the upper half of the body leads the lower half of the body and is thrown down like a "big tree toppling." This pitching form constitutes a form in which an individual with a strong upper body uses the muscle power thereof in a leading manner, and only uses the power of the lower half of the body subordinately, and so-called total body pliancy is limited. Most American pitchers typical of the American major leagues use a linear form like this.

If this pitching form is analyzed, the arm holding the ball is already in the "top position" (top of the path described by the circular motion of the arm) when the stepping leg is planted on the ground, and the upper half of the body is thrown down as-is "like a giant tree toppling." One of the characteristics of this pitching form is that the timing at which the arm of the side holding the ball, and the arm holding the glove separate, the so-called "breaking of the hands," is fast, and they "break at the location of the chest."

Further, because this pitching form makes the most of strong upper body characteristics, when a pitcher consciously "attempts to throw the ball even faster," a shortcoming is likely to appear, whereby emphasis is placed on the shoulder and arm, and the pitch goes high. Furthermore, the ball not only rises, but from the batter's perspective, the timing of this pitching form can be said to be an extremely easy to read rhythm. As for the way a batter reads the timing, he begins his take-back to coincide with the pitcher raising his left leg and moving forward, and waits for the pitch. Since the rhythm of the batter waiting for the ball is "1, 2," at this timing, if the pitcher throws at the same "1, 2" rhythm, the pitch will coincide exactly with the timing "3" of the batter's swing, and is clearly extremely easy to hit back.

With this pitching form, how to throw breaking balls becomes important. As is clear from just watching American baseball, the fact that increasing numbers of pitchers are throwing lots of changeups and "moving fast balls," by which even straight balls sink or curve right or left, is understandable. It is also a fact that the situation has escalated to the point of illegal pitches, such as applying vaseline to one's fingers, and using files to make cuts in the ball so that it will break better.

(b) Pitching Rhythm of "Low Center of Gravity Pitching Form"

By contrast, a pitching form in which the location of the center of gravity is low, and there is a "1, 2-, 3" rhythm during which adjustments are made during the pause, is one in which the circular motion of the upper half of the body follows after the circular motion of the lower half of the body. Further, this is also a suitable way of pitching for Japanese pitchers, who are lacking in height and overall body musculature.

In this form, the hand gripping the ball and the hand holding the glove are over the pitching rubber even during the windup and in the set position, and moreover, break in the "location of the abdomen." In the previous form, the two hands broke in the "location of the chest," but in this form, the hands are slowly lowered to the "location of the abdomen." This approach enables the ball to be held as long as possible, and is the most important checkpoint constituting lower body-led pitching.

As a characteristic, there can be cited the fact that, with a right-handed pitcher, the right hand, which is holding the ball, is below the elbow, that is, is in an "under position" (the deepest position of the take-back) relative to the "top position" until immediately prior to the left leg being planted.

For a pitching form with this "2-" rhythm, because the circular motion of the lower half of the body takes the initiative and leads the circular motion of the upper half of the body, and makes use of the "pliancy" of the body, balls can be easily clustered low, ball control is achieved, and a powerful delivery is also realized. This is a so-called "hold the ball for a long time" form, which, for the batter, makes it difficult to see where the ball will come from.

(c) Why a "2-" Rhythm Instead of a "2"

Prior thereto, "power" will be described. A powerful delivery is just that, a ball that is delivered with power, but the important thing is whether or not it has power relative to a batter. It is not only velocity, but "sharpness," that is, the true nature of "power" is a ball that hops in the vicinity of the batter. The case where a pitcher, who is being hit and has to leave the mound even though his pitching speed is in the high 140 kilometer per hour range, and a pitcher, who does well even with a 120 kilometer per hour fast ball depends on whether or not "the pitcher's power is sharp."

In general, "control and speed have a reciprocal relationship," such that when a pitcher attempts to improve his control, he has to lower his speed, and when he attempts to increase his speed, his control falters. This pitching theory is based on the premise that the relationship between "sharpness and control has a synergistic effect." This is so because, as seen with the above-mentioned pitcher with really sharp pitches, total control is good. A pitcher, who simply tries to increase his speed has no control. "Power" in the true sense is when "sharpness," "control" and "speed" are all uniform, enabling a pitcher to stay on the mound.

A condition that must be present therefor is the "2-" rhythm, in which the secret to producing "power" lies. Furthermore, three checkpoints for ensuring the realization of a "2-" rhythm are the three points hereinbelow.

[1] Are the hands breaking in the location of the abdomen?

[2] Is the pitching side snap in the "under position" immediately prior to planting the foot?

[3] Is the arm swinging up in an accelerated manner from the "under position" to the "top position" with good timing in line with the "position of the center of gravity?"

(6) Practice for Learning the "1, 2-, 3" Rhythm (a) Quick Pitching Form

In this form, the set position is assumed, "1" is omitted, and pitching practice is continued in a quick motion from "2-, 3". Moving in response to the "quick center of gravity shift," in which the leg of the stepping side moves quickly forward without being raised up, the user grasps the "timing for swinging up in an accelerated manner" the arm from the "down position" to the "top position." Thereafter, he simply pivots the body and pitches.

Maintaining the "2-" rhythm even in this speedy pitching motion systematically achieves "power and control." Omitting the motion in which the leg is raised up makes it easier to consciously focus on the "2-" sense of rhythm.

(b) To Understand the Sense of Rhythm of "2-"

"Throwing at a good tempo" is always kept in mind. During practice and in games, the catcher throws the ball back to the pitcher as soon as he catches it, and the pitcher immediately prepares to pitch. If daily pitching practice is set at 50 balls, shorten the time required as much as possible. If the "1, 2-, 3" rhythm can be acquired via pitching practices of such a short pitching tempo, one's power can be increased roughly 5–10% in an extremely short period of time.

Once a pitcher actually tries this kind of practice, it should become clear that this approach is significantly tougher physically than throwing several hundred balls out of force of habit. This practice also builds up stamina.

FIG. 9 through FIG. 14 illustrate by dividing into stages 1–4 a method for utilizing, in the case of a left-handed pitcher, any of the above-mentioned pitching training tool 1, 1A, 1B, for example 1, for healthfully and easily acquiring an ideal pitching form based on the Imato pitching theory such as this. Furthermore, each (A) in each of these figures is a front view as seen from the home plate side, and (B) of each figure is a side view of (A) of each of the same figures.

(Stage 1)

Figure 9A:
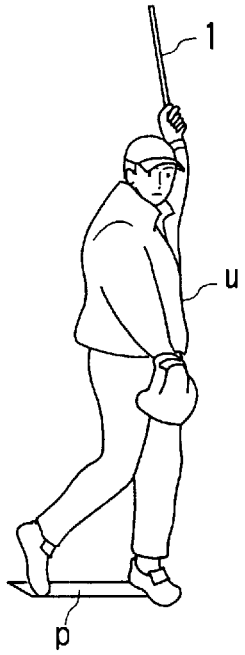
FIG. 9A is a front view of the first step in stage 1 of a method of utilization of the pitching training tool shown in FIG. 1.
Figure 9B:
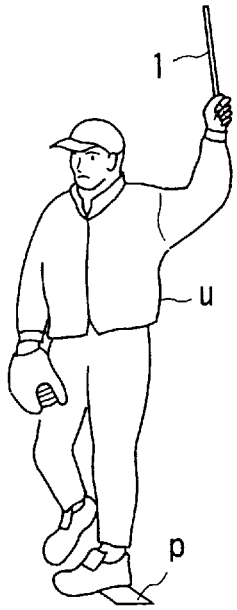
FIG. 9B is a side view of FIG. 9A.

First, as shown in FIG. 2, a user u grips the grip 3 of the pitching training tool 1 with his pitching hand 5, and as shown in FIG. 9A and FIG. 9B, when he places both feet on the ends of the pitching rubber P, places the center of gravity on his left leg by straightening his left knee, and, in that state, opens up the upper half of his body 90 degrees, automatically only the tips of the toes of the right foot remain on the pitching rubber P (the pivoting foot at this time is the left foot). The arm of the side holding the pitching training tool 1 (left arm) is raised such that the elbow forms a right angle. As much as possible, the elbow is an extension of the shoulder. Further, the tip of the shaft 2 of the pitching training tool 1 points straight up, and the wrist of the hand gripping same is twisted so that the palm faces outwardly.

Figure 10A:
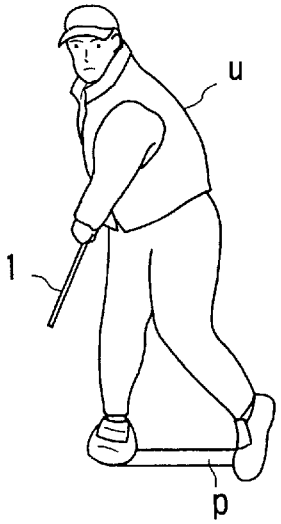
FIG. 10A is a front view of the second step in stage 1 of a method of utilization of the pitching training tool shown in FIG. 1.
Figure 10B:
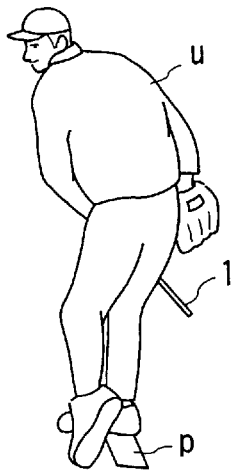
FIG. 10B is a side view of FIG. 10A.

Next, as shown in FIG. 10A and FIG. 10B, from this form, the center of gravity is shifted to the right, and the shoulder is rotated toward the right side, on which the center of gravity is placed, while at the same time swinging the pitching training tool 1 down.

(Stage 2)

Figure 11A:
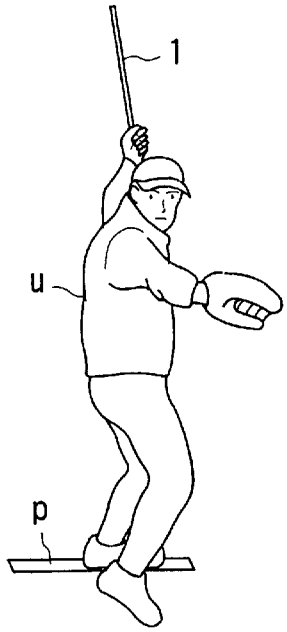
FIG. 11A is a front view of the first step in stage 2 of a method of utilization of the pitching training tool shown in FIG. 1.
Figure 11B:
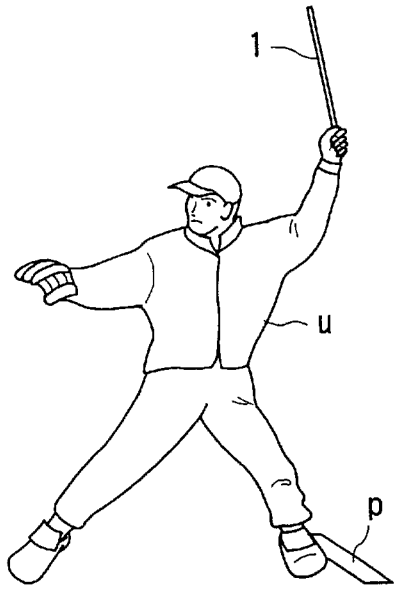
FIG. 11B is a side view of FIG. 11A.
Figure 12A:
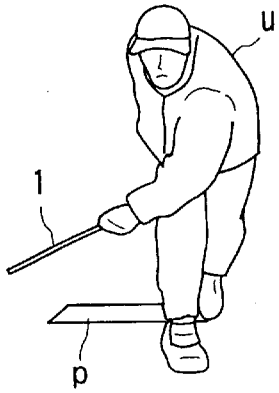
FIG. 12A is a front view of the second step in stage 2 of a method of utilization of the pitching training tool shown in FIG. 1.
Figure 12B:
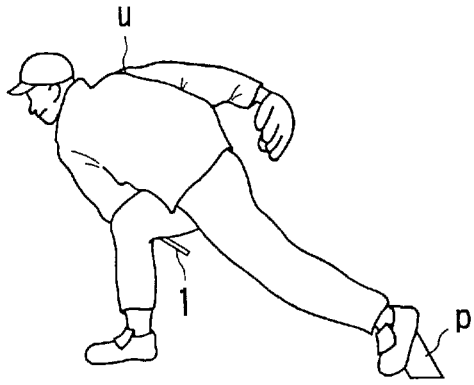
FIG. 12B is a side view of FIG. 12A.

Next, as shown in FIG. 11A and FIG. 11B, a user u first places the pivoting foot, the left foot, practically parallel on top of the pitching rubber P, and places the right foot at a spot approximately three foot lengths away from the longitudinal center of the pitching rubber P perpendicular to the direction of the pitching rubber P. At this time, as shown in FIG. 12A and FIG. 12B, when the arm is swung down the same as in stage 1, it is a state, in which the center of gravity shifts to the right, the right knee is bent approximately 90 degrees, and the elbow of the swung down left arm reaches the right knee.

(Stage 3)

Figure 13A:
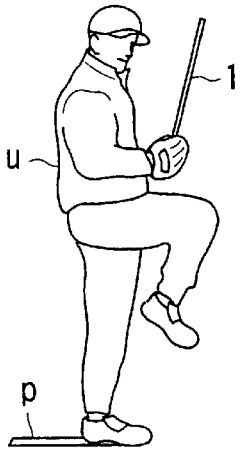
FIG. 13A is a front view of the first step in stage 3 of a method of utilization of the pitching training tool shown in FIG. 1.
Figure 13B:
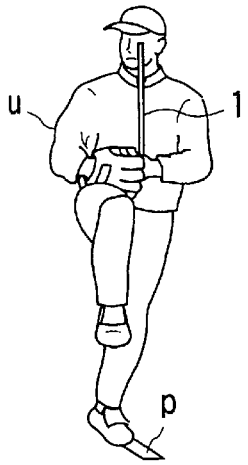
FIG. 13B is a side view of FIG. 13A.
Figure 14A:
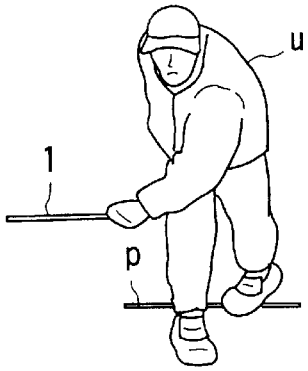
FIG. 14A is a front view of the second step in stage 3 of a method of utilization of the pitching training tool shown in FIG. 1.
Figure 14B:
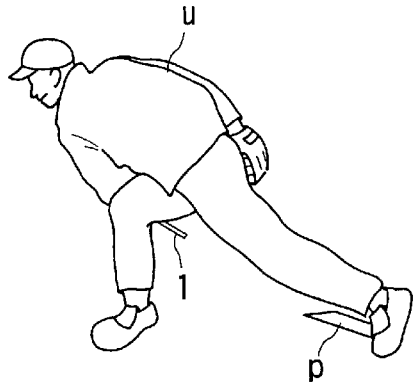
FIG. 14B is a side view of FIG. 14A.

As shown in FIG. 13A and FIG. 13B, the user u first places his left foot (pivoting foot) practical parallel in the center on top of the pitching rubber P, stands up straight with good balance, raises the opposite right leg up high, and next, as shown in FIG. 14A and FIG. 14B, steps the raised right leg to a spot roughly five foot lengths toward the front, and swings the pitching training tool 1 down using the same form as in the above-mentioned stage 2. At this time, a state in which the tips of the toes of the right foot are touching the pitching rubber P and the knee is extended is desirable.

(Stage 4)

As shown in FIG. 13A and FIG. 13B, the user u starts from the form of the above-mentioned stage 3, and at the finish, which is shown in FIG. 14A and FIG. 14B, cultivates a sense of balance by maintaining for a prescribed time a state in which he is standing on the right foot of his pivoting leg, and the sole of the spikes of his left foot are facing upward.

(Stage 5)

After carrying out the above stages 1–4 in a successive manner, the user u takes a form constituted by planting both feet slightly wider than his shoulders, and lowering his hips. This series of actions is regarded as 1 set, and a prescribed number of sets is performed.

Then, according to the method of utilization of a pitching training tool 1, 1A, 1B such as this, the pitching training tool 1, 1A, 1B thereof comes to feel just like a fourth joint contiguous to the three joints, the shoulder joint, elbow joint and wrist joint, of the throwing arm.

Thus, it is possible to perform shadow pitching while being conscious of the top position of the throwing arm and hand, the twisting of the wrist and the state thereof, and the path of the throwing arm and hand.

Further, because the flexible shaft 2 generates a sharp air-cutting sound when the throwing arm is swung down, it is possible to become aware of the swinging speed of the arm by the level of the tone of the air-cutting sound thereof. Thus, it is possible to perform shadow pitching while being conscious of the speed at the release point and other important points of a pitch. Furthermore, because the number of times a pitching training tool is swung is displayed on a display, it is also possible to check the number of times thereof.

Thus, because it is possible to readily check the quality of one's own pitching motion and form, by repeatedly carrying out the shadow pitching thereof, it is possible to either readily cultivate a pitching form of one's own pitching, or to easily acquire the Imato-style or other such arbitrary pitching form, while revising one's own pitching motion and form.

Moreover, because the total weight of the pitching training tool 1, 1A, 1B thereof is lighter than that of a regulation hardball, it is possible to greatly reduce the stress placed on the throwing arm, shoulder, elbow and joints thereof. Thus, it is possible to perform shadow pitching healthfully and enjoyably without wearing out the throwing arm, shoulder, elbow and joints thereof, and further, without shortening a pitching career.

Further, in addition to the stress on the throwing arm, shoulder, elbow and joints thereof being low, since the pitching motion is a total body movement, the present invention also has the effect of preventing stiffening of the shoulder and subacromial bursitis, and can promote health.

Furthermore, because the casing 30, which houses the rotational frequency detector, and display 6 are provided on the gripping portion 3 side instead of being disposed at the tip portion side of the rod-shaped pitching training tool 1, even if the rod-shaped tip portion should impact the ground or something when the pitching training tool is swung down, damage to the rotational frequency detector and display thereof can be prevented.

Furthermore, the rotational speed when the pitching training tool 1, 1A, 1B is swung around can be checked more accurately via the display 6 than the air-cutting sound of the shaft 2. Further, since this rotational speed detector 34 displays on the display 6 the rotational speed detection value thereof as the pitching speed of a ball had the ball in question been thrown at the arm swing speed thereof, the enjoyment of shadow pitching can be increased.

Apart from the air-cutting sound of the shaft 2, since a plurality of tonal sounds that differ in accordance with the rotational speed of the pitching training tool 1, 1A, 1B, are outputted from the sound outputting device 37, by listening to the sounds thereof, it is possible to learn, while shadow pitching, the swing speed of the shaft 2 or the pitching speed more accurately than by the air-cutting sound.

Thus, since it is not necessary to stop shadow pitching part way through each time to look at the display 6 showing the rotational speed of the pitching training tool 1, 1A, 1B, it is possible to enhance the effects of practice.

Further, since the length of the shaft 2 of a pitching training tool 1, 1A, 1B can be appropriately adjusted in accordance with the body size of a user u, especially his height, and the method of practice, a single pitching training tool 1, 1A, 1B can be widely used by everyone from adults to children.

Furthermore, slippage when a user u grips the gripping portion 3 of a pitching training tool 1, 1A, 1B can be prevented by a non-slip portion 10 and a grip end 4. Thus, since it is possible to prevent a pitching training tool 1, 1A, 1B from slipping out of the gripping hand when the pitching training tool 1, 1A, 1B thereof is swung down, the safety of the surrounding area can be enhanced.

Furthermore, since the gripping portion 3 of a pitching training tool 1, 1A, 1B is formed into either a ball-shaped grip 7 approximating a regulation hardball, or a triangular-shaped grip 8 or other such arbitrarily shaped body, it is possible to securely grip the grips thereof 7, 8 in practically the same manner as a regulation hardball, while at the same time making it possible to prevent slippage. Furthermore, in each of the above embodiments, a case in which each pitching training tool 1, 1A, 1B was used in the shadow pitching of a pitcher was explained, but the present inventions can also be used in the shadow pitching of the throwing motion of fielders.

Figure 15:
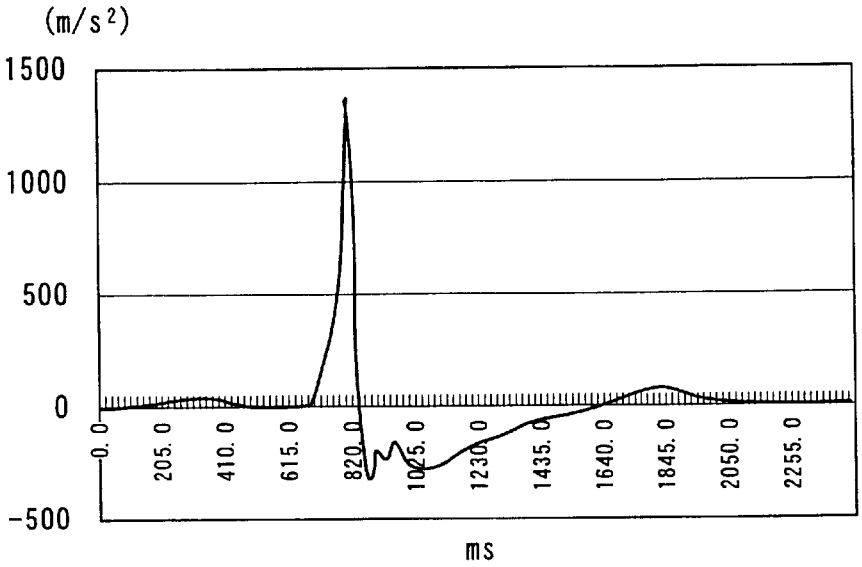
FIG. 15 is a graph showing an example of an acceleration waveform of a pitch.
Figure 16:
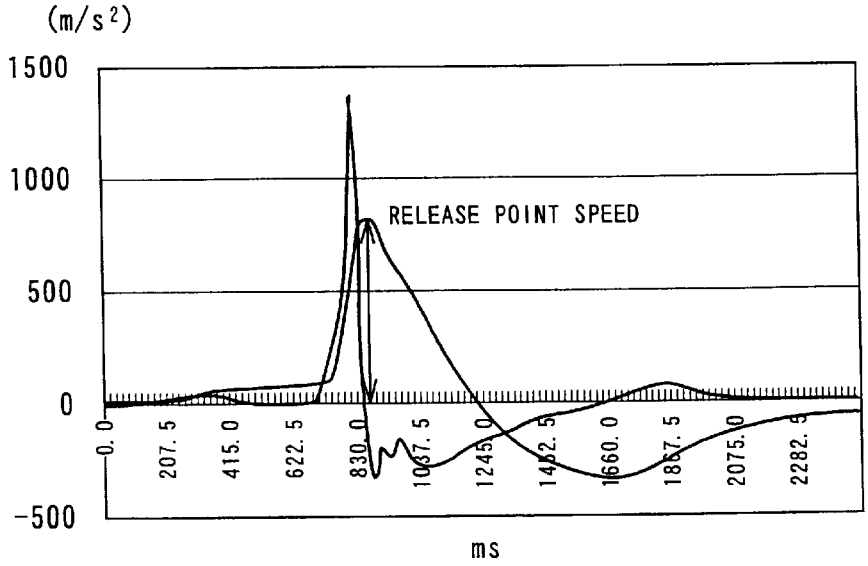
FIG. 16 is a speed waveform diagram according to FIG. 15.
Figure 17:
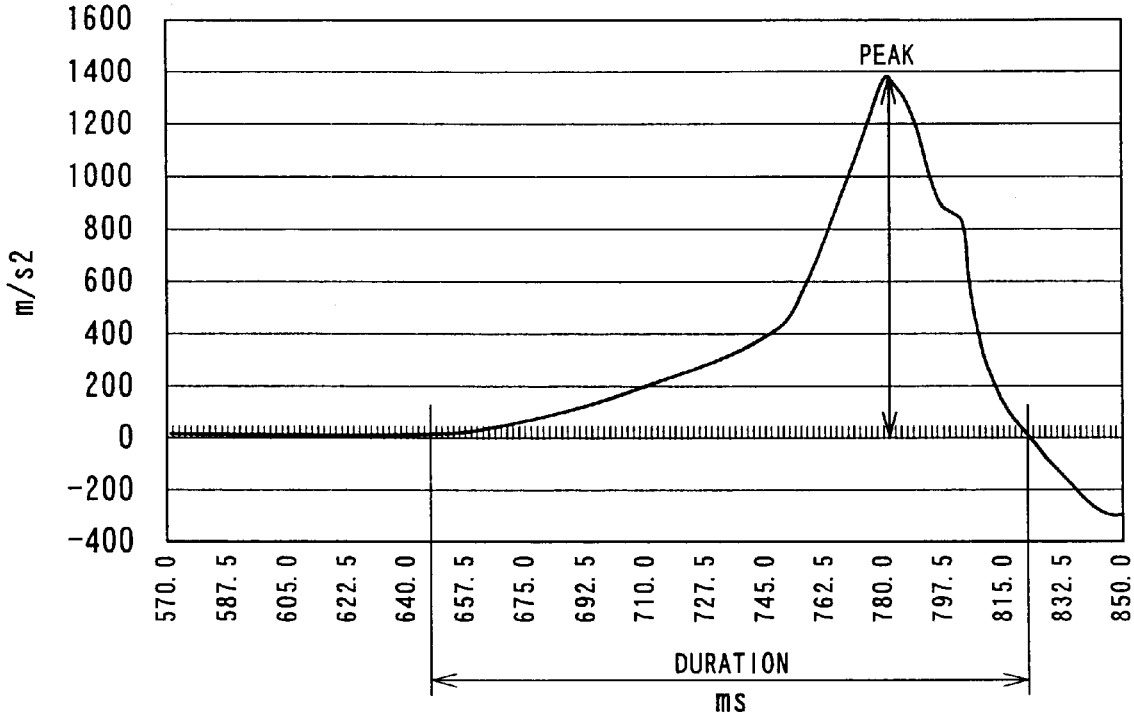
FIG. 17 is a graph showing speed, peak value and duration.

Furthermore, FIG. 15 shows an example of an acceleration waveform when pitching was actually performed using a pitching training tool 1 according to the invention of the present application, and FIG. 16 shows the speeds (speed waveforms) achieved via the integration of the acceleration waveforms thereof. As is clear from FIG. 16 thereof, the highest point of speed (that is, the point at which acceleration initially crosses 0 from the peak) constitutes the release point. Further, FIG. 17 shows the speed, peak g, and duration of a pitching training tool 1 at the release point as waveform data related to the above-mentioned pitching form.

What is claimed is:

1. A baseball pitching training tool comprising:

a rod-shaped body portion having a hollow cylindrical shaft portion that is of a lighter weight than a regulation ball and a gripping portion integrally formed at one end of the shaft portion, said gripping portion having one end formed as a grip having a diameter larger than that of said rod-shaped body portion;

a detector, which is incorporated in said gripping portion side of the rod-shaped body portion and which detects a state of motion when the rod-shaped body portion is swung around;

an arithmetic processing portion, which is disposed on the gripping portion side of said rod-shaped body and which performs computations based on motion state data from said detector; and a display disposed on the gripping portion side of the rod-shaped body and displays the results of computations by said arithmetic processing portion, the weight of the pitching training tool being lighter than a regulation baseball.

2. The pitching training tool according to claim 1, wherein said detector is an acceleration sensor and said arithmetic processing portion is a CPU comprising means for detecting a rotational frequency and rotational speed detecting means for detecting rotational speed, when the rod-shaped body portion is being swung around.

3. The pitching training tool according to claim 2, wherein said display is constituted so as to display at least one of a rotational speed and a pitching speed, the pitching speed being converted based on the rotational speed.

4. The pitching training tool according to claim 2, wherein a sound device, operatively connected to said computing means and constituted so as to output sounds in different tones according to a speed level of a rotational speed, is incorporated in the gripping portion side of the rod-shaped body portion.

5. The pitching training tool according to claim 4, wherein said rotational frequency detector, said rotational speed detector and said sound device are housed in a single casing as a unit.

6. The pitching training tool according to claim 5 wherein said display device is housed within said rod-shaped body.

7. The pitching training tool according to claim 1, wherein the shaft portion of said rod-shaped body portion is made flexible and formed of a glass fiber.

8. The pitching training tool according to claim 1, wherein the shaft portion of said rod-shaped body portion is made flexible and formed of titanium.

9. The pitching training tool according to claim 1, wherein the shaft portion of said rod-shaped body portion is made flexible and formed of carbon.

10. The pitching training tool according to claim 1, wherein a non-slip portion for preventing slipping of a gripping hand is formed on said gripping portion.

11. The pitching training tool according to claim 10, wherein a grip end of a diameter larger than the non-slip portion is formed at an outer end portion of said non-slip portion.

12. The pitching training tool according to claim 1, wherein said gripping portion comprises either a spherical body of a diameter greater than said rod-shaped body portion, or a triangular-shaped body of a size greater than the length perpendicular to the axis of the rod-shaped body portion.

* * * * *